United States Patent [19]

Kalnes et al.

[11] Patent Number: 5,004,533

[45] **Date of Patent: * Apr. 2, 1991**

[54] PROCESS FOR TREATING AN ORGANIC STREAM CONTAINING A NON-DISTILLABLE COMPONENT TO PRODUCE AN ORGANIC VAPOR AND A SOLID

[75] Inventors: Tom N. Kalnes, La Grange; Robert B. James, Jr., Northbrook, both of Ill.

[73] Assignee: UOP, Des Plaines, Ill.

[ * ] Notice: The portion of the term of this patent subsequent to Apr. 4, 2006 has been disclaimed.

[21] Appl. No.: 491,768

[22] Filed: Mar. 12, 1990

[51] Int. Cl.[5] ..... C10B 55/00

[52] U.S. Cl. ..... 208/50; 208/81; 208/92; 208/93; 208/107; 208/143

[58] Field of Search ..... 208/50, 81, 84, 92, 208/93, 107, 143, 262.1, 262.5, 94

[56] References Cited

U.S. PATENT DOCUMENTS 3,992,285 11/1976 Hutchings ..... 208/208 R
4,297,197 1/1989 Mallari ..... 208/50 X
4,818,368 4/1989 Kalnes et al. ..... 208/50
4,840,721 6/1989 Kalnes et al. ..... 208/81 X
4,840,722 6/1989 Johnson et al. ..... 208/95
4,882,037 11/1989 Kalnes et al. ..... 208/94 X

*Primary Examiner*—Curtis R. Davis
*Assistant Examiner*—William Diemler
*Attorney, Agent, or Firm*—Thomas K. McBride; John G. Tolomei; John G. Cutts, Jr.

[57] ABSTRACT

A process for treating an organic stream containing a non-distillable component to produce an organic vapor stream and a solid which process comprises the steps of: (a) contacting the organic stream containing a non-distillable component with a hydrogen-rich gaseous steam having a temperature greater than the organic stream in a flash zone at flash conditions thereby increasing the temperature of the organic stream and vaporizing at least a portion thereof to produce an organic vapor stream comprising hydrogen and a heavy stream comprising the non-distillable component; and (b) reacting at least a portion of the heavy stream comprising the non-distillable component in the presence of hydrogen in a pyrolysis zone to produce a thermally stabilized volatile organic stream comprising hydrogen and a solid.

22 Claims, 1 Drawing Sheet

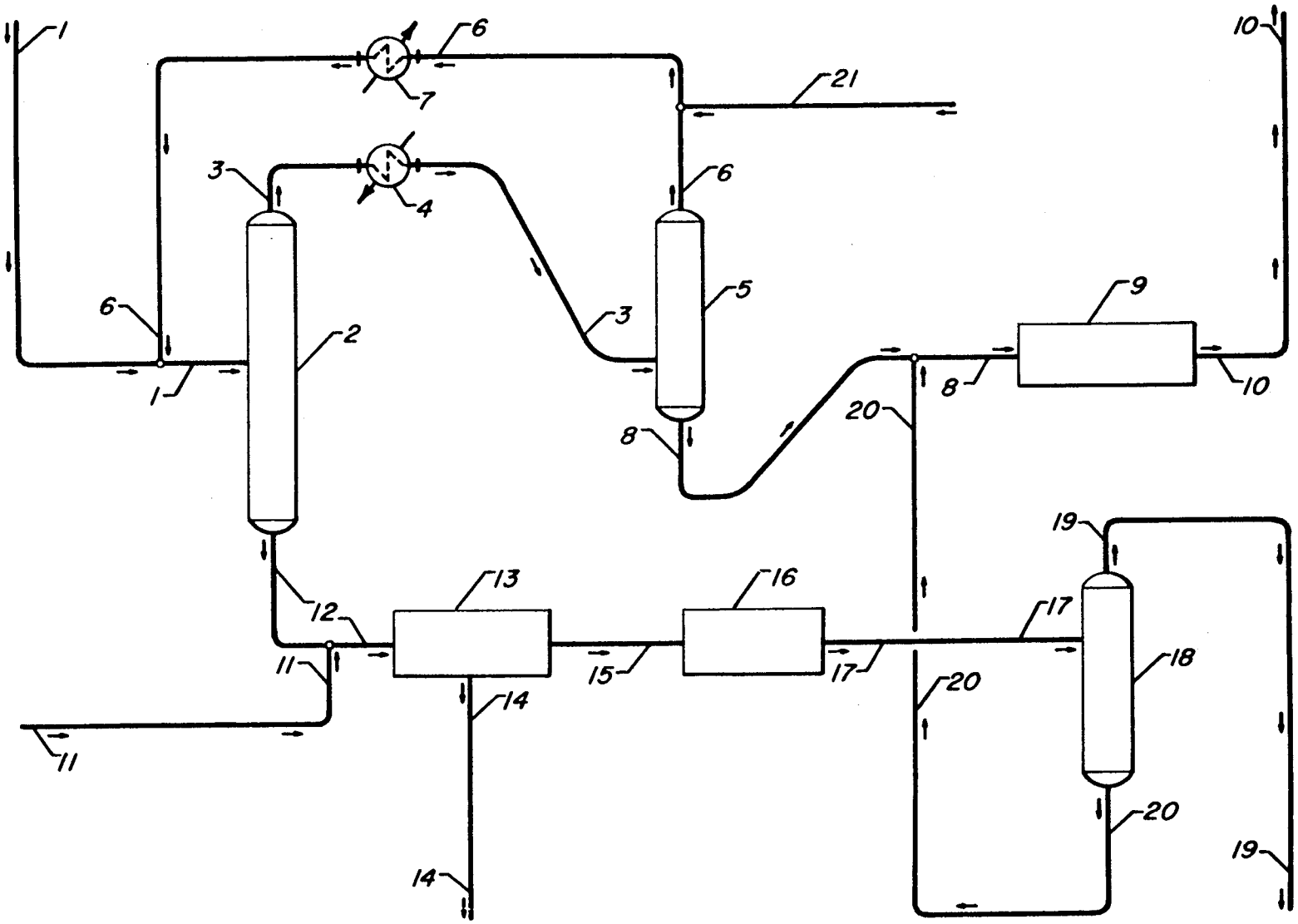
1
2
3
4
5
6
7
8
9
10
11
12
13
14
15
16
17
18
19
20
21

PROCESS FOR TREATING AN ORGANIC STREAM CONTAINING A NON-DISTILLABLE COMPONENT TO PRODUCE AN ORGANIC VAPOR AND A SOLID

BACKGROUND OF THE INVENTION

The field of art to which this invention pertains is the production of a volatile organic stream from an organic stream containing a non-distillable component. More specifically, the invention relates to a process for treating an organic stream containing a non-distillable component to produce an organic vapor stream and a solid which process comprises the steps of: (a) contacting the organic stream containing a non-distillable component with a hydrogen-rich gaseous stream having a temperature greater than the organic stream in a flash zone at flash conditions thereby increasing the temperature of the organic stream and vaporizing at least a portion thereof to produce an organic vapor stream comprising hydrogen and a heavy stream comprising the non-distillable component; and (b) reacting at least a portion of the heavy stream comprising the non-distillable component in the presence of hydrogen in a pyrolysis zone to produce a thermally stabilized volatile organic stream comprising hydrogen and a solid.

There is a steadily increasing demand for technology which is capable of treating an organic stream containing a non-distillable component to produce a volatile organic stream and a solid having a low level of organic contaminants.

With the increased environmental emphasis for the treatment and recycle of organic waste streams containing a non-distillable component there is an increased need for improved processes to separate the non-distillable component from an organic vapor stream and then convert the non-distillable component to a solid which may be responsibly utilized. For example, during the disposal or recycle of potentially environmentally harmful organic waste streams, an important step in the total solution to the problem is to produce an organic vapor stream which facilitates the ultimate resolution to produce product streams which may subsequently be handled in an environmentally acceptable manner. One environmentally attractive method of treating organic waste streams is by hydrogenation. Therefore, those skilled in the art have sought to find feasible techniques to remove heavy non-distillable components from an organic stream to produce an organic vapor stream which may then be hydrogenated and to provide a solid possessing a low level of organic contaminants.

The presence of a non-distillable component including finely divided particulate matter in an organic feed to a hydrogenation zone greatly increases the difficulty of the hydrogenation. A non-distillable component tends (1) to foul the hot heat exchange surfaces which are used to heat the feed to hydrogenation conditions, (2) to form coke or in some other manner deactivate the hydrogenation catalyst thereby shortening its active life and (3) to otherwise hinder a smooth and facile hydrogenation operation. Particulate matter in a feed stream tends to deposit within the hydrogenation zone and to plug a fixed hydrogenation catalyst bed thereby abbreviating the time on stream.

INFORMATION DISCLOSURE

In U.S. Pat. No. 3,992,285 (Hutchings), a process is disclosed for the desulfurization of a hydrocarbonaceous black oil containing sulfur and asphaltic material which comprises preheating the oil by indirect heat exchange to a temperature not in excess of about 550° F., commingling the preheated oil with a steam-containing gas to raise the temperature of the oil to a desulfurization temperature of about 600° F. to about 800° F. and contacting the thus heated oil at hydrocarbon conversion conditions with a desulfurization catalyst.

In U.S. Pat. No. 4,840,722 (Johnson et al), a process is disclosed for the thermal non-catalytic conversion of a hydrocarbonaceous stream containing less than about 5 weight percent halogenated organic compounds in the presence of hydrogen.

In U.S. Pat. No. 4,818,368 (Kalnes et al), a process is disclosed for treating a temperature-sensitive hydrocarbonaceous stream containing a non-distillable component to produce a hydrogenated distillable hydrocarbonaceous product which incorporates a hot flash separation zone and a coking zone.

BRIEF SUMMARY OF THE INVENTION

The invention provides an improved process for the production of a volatile organic stream from an organic stream containing a non-distillable component and a solid by means of contacting the organic feed stream with a hot hydrogen-rich gaseous stream to increase the temperature of the organic feed stream to vaporize at least a portion of the distillable organic compounds thereby producing a volatile organic stream containing hydrogen and a heavy stream containing the non-distillable component which is immediately reacted in an integrated pyrolysis zone in the presence of hydrogen. The pyrolysis zone is operated in the presence of hydrogen at conditions selected to produce a thermally stabilized volatile organic stream and a solid. Important elements of the improved process are the relatively short time that the feed stream is maintained at elevated temperature during the separation of the non-distillable component, the avoidance of heating the feed stream via indirect heat exchange to preclude the coke formation that could otherwise occur in heaters, the minimization of utility costs due to the integration of the pyrolysis zone and the minimization of organic components, in the solid.

One embodiment of the invention may be characterized as a process for treating an organic stream containing a non-distillable component to produce an organic vapor stream and a solid which process comprises the steps of: (a) contacting the organic stream containing a non-distillable component with a hydrogen-rich gaseous stream having a temperature greater than the organic stream in a flash zone at flash conditions thereby increasing the temperature of the organic stream and vaporizing at least a portion thereof to produce an organic vapor stream comprising hydrogen and a heavy stream comprising the non-distillable component; and (b) reacting at least a portion of the heavy stream comprising the non-distillable component in the presence of hydrogen in a pyrolysis zone to produce a thermally stabilized volatile organic stream comprising hydrogen and a solid.

Another embodiment of the invention may be characterized as a process for treating an organic stream containing a non-distillable component to produce a volatile organic stream and a solid which process comprises the steps of: (a) contacting the organic stream containing a non-distillable component with a first hydrogen-rich gaseous stream having a temperature greater than the organic stream in a flash zone at flash conditions thereby increasing the temperature of the organic stream and vaporizing at least portion thereof to produce an organic vapor stream comprising hydrogen and a heavy stream comprising the non-distillable component; (b) reacting at least a portion of the heavy stream comprising the non-distillable component in the presence of hydrogen in a pyrolysis zone to produce a thermally stabilized volatile organic stream comprising hydrogen and a solid; (c) separating the organic vapor stream comprising hydrogen recovered in step (a) to produce a second hydrogen-rich gaseous stream; and (d) recycling at least a portion of the second hydrogen-rich gaseous stream recovered in step (c) to provide at least a portion of the first hydrogen-rich gaseous stream utilized in step (a).

Yet another embodiment of the invention may be characterized as a process for treating an organic stream containing a non-distillable component to produce distillable hydrocarbonaceous compounds and a solid which process comprises the steps of: (a) contacting the organic stream containing a non-distillable component with a first hydrogen-rich gaseous stream having a temperature greater than the organic stream in a flash zone at flash conditions thereby increasing the temperature of the organic stream and vaporizing at least a portion thereof to produce an organic vapor stream comprising hydrogen and a heavy stream comprising the non-distillable component; (b) reacting at least a portion of the heavy stream comprising the non-distillable component in the presence of hydrogen in a pyrolysis zone at pyrolysis conditions to produce a thermally stabilized volatile organic stream comprising hydrogen and a solid; (c) contacting at least a portion of the organic vapor stream comprising hydrogen produced in step (a) and at least a portion of the thermally stabilized volatile organic stream comprising hydrogen produced in step (b) with a hydrogenation catalyst in a hydrogenation reaction zone at hydrogenation conditions; (d) separating at least a portion of the organic vapor stream comprising hydrogen produced in step (a) to produce a second hydrogen-rich gaseous stream; (e) recycling at least a portion of the second hydrogen-rich gaseous stream recovered in step (d) to provide at least a portion of the first hydrogen-rich gaseous stream utilized in step (a); and (f) recovering distillable hydrocarbonaceous compounds from the effluent of the hydrogenation reaction zone.

Other embodiments of the present invention encompass further details such as preferred feedstocks and operating conditions, all of which are hereinafter disclosed in the following discussion of each of these facets of the invention.

BRIEF DESCRIPTION OF THE DRAWING

The drawing is a simplified process flow diagram of a preferred embodiment of the present invention.

DETAILED DESCRIPTION OF THE INVENTION

The present invention provides an improved integrated process for the removal of heavy non-distillable components from an organic stream and, in one embodiment, the subsequent hydrogenation of the distillable organic stream. A wide variety of organic streams are to be candidates for feed streams in accordance with the process of the present invention. In particular, a preferred feedstock for the process of the present invention is the distillation residues or by-products from vinyl chloride monomer production and which residues comprise non-distillable components and halogenated hydrocarbons. Examples of other organic streams which are suitable for treatment by the process of the present invention are dielectric fluids, hydraulic fluids, heat transfer fluids, used lubricating oil, used cutting oils, used solvents, still bottoms from solvent recycle operations, coal tars, atmospheric residuum, oils contaminated with polychlorinated biphenyls (PCB), halogenated wastes, petrochemical by-products, off-specification plastic waste, used plastic waste and other organic industrial waste. Many of these organic streams may contain non-distillable components which include, for example, organometallic compounds, inorganic metallic compounds, finely divided particulate matter, halogenated organic polymers and non-distillable hydrocarbonaceous compounds. The present invention is particularly suitable for processing organic feed streams which are considered hazardous wastes and contain hazardous organic compounds. The present invention is particularly advantageous when the non-distillable components comprise sub-micron particulate matter and halogenated compounds and the conventional techniques of filtration or centrifugation tend to be highly ineffective.

Once the organic feed stream is separated into a distillable organic stream and a heavy non-distillable stream, the resulting distillable organic stream is, in one embodiment, introduced into a hydrogenation zone. If the feed stream contains metallic compounds which contain metals such as zinc, copper, iron, barium, phosphorus, magnesium, aluminum, lead, mercury, cadmium, cobalt, arsenic, vanadium, chromium, and nickel or salts such as sodium chloride and calcium chloride, for example, these compounds will be isolated in the relatively small volume of the recovered heavy non-distillable stream which is recovered from the flash zone and which is then introduced into a pyrolysis zone in the presence of hydrogen. In the event that the original feed stream contains distillable hydrocarbonaceous compounds which include sulfur, oxygen, nitrogen, metal or halogen components, the hydrogenation of the resulting recovered distillable organic stream will remove or convert such components as desired. In a preferred embodiment of the present invention, the hydrogenation of the resulting distillable organic stream is preferably conducted immediately without intermediate separation or condensation. In another preferred embodiment of the present invention, the pyrolysis of the heavy stream comprising a non-distillable component is also preferably conducted without intermediate separation or complete cooling in the interest of economy and ultimate conversion to distillable hydrocarbonaceous compounds. The pyrolysis reaction in one aspect serves to encase non-volatile particulate matter and potentially leachable hazardous metals in the resulting carbon-rich solid thus providing a stable solid. The purpose of introducing hydrogen into the pyrolysis zone is to reduce both the yield and organic compound content of the solid. The quantity of solid is generally significantly less voluminous than the original organic feedstock or the feed to the pyrolysis reaction zone which is advantageous for reuse or ultimate disposal. The solid can also potentially be reused as a substitute for activated carbon, solid fuel, or electrode construction material.

In accordance with the subject invention, an organic stream containing a non-distillable component is contacted with a hot hydrogen-rich gaseous stream having a temperature greater than the organic stream in a flash zone at flash conditions thereby increasing the temperature of the organic stream and vaporizing at least a portion thereof to provide an organic vapor stream comprising hydrogen and a heavy non-distillable stream. The hot hydrogen-rich gaseous stream preferably comprises more than about 40 mole % hydrogen and more preferably more than about 90 mole % hydrogen. The hot hydrogen-rich gaseous stream is multifunctional and serves as 1) a heat source used to directly heat the organic feed stream to preclude the coke formation that could otherwise occur when using an indirect heating apparatus such as a heater or heat-exchanger, 2) a diluent to reduce the partial pressure of the organic compounds during vaporization in the flash zone, 3) a possible reactant to minimize the formation of polymers at elevated temperatures, 4) a stripping medium and 5) at least a portion of the hydrogen required in the hydrogenation reaction zone of one embodiment. In accordance with the subject invention, the organic feed stream is preferably maintained at a temperature less than about 482° F. (250° C.) before being introduced into the flash zone in order to prevent or minimize the thermal degradation of the feed stream. Depending upon the characteristics and composition of the organic feed stream, the hot hydrogen-rich gaseous stream is introduced into the flash zone at a temperature greater than the organic feed stream and preferably at a temperature from about 200° F. (93° C.) to about 1200° F. (649° C.).

During the contacting, the flash zone is preferably maintained at flash conditions which include a temperature from about 150° F. (65° C.) to about 860° F. (460° C.), a pressure from about atmospheric to about 2000 psig (13788 kPa gauge), a hydrogen circulation rate of about 1000 SCFB (168 normal $m^3/m^3$) to about 100,000 SCFB (16850 normal $m^3/m^3$) based on the organic feed stream and an average residence time of the hydrogen-containing, organic vapor stream in the flash zone from about 0.1 seconds to about 50 seconds. A more preferred average residence time of the hydrogen-containing, organic vapor stream in the flash zone is from about 1 second to about 10 seconds.

The resulting heavy non-distillable portion of the feed stream is recovered from the bottom of the flash zone as required as a heavy non-distillable stream. The heavy non-distillable stream may contain a relatively small amount of distillable components but since essentially all of the non-distillable components contained in the organic feed stream are recovered in this stream, the term "heavy non-distillable stream" is nevertheless used for the convenient description of this stream. The heavy non-distillable stream preferably contains a distillable component concentration of less than about 30 weight percent and more preferably less than about 10 weight percent. Under certain circumstances with a feed stream not having an appreciable amount of liquid non-distillable components, it is contemplated that an additional liquid may be utilized to flush the heavy non-distillables from the flash zone. An example of this situation is when the organic feed stream comprises a very high percentage of distillable organic compounds and relatively small quantities of finely divided particulate matter (solid) and essentially no liquid non-distillable component for use as a carrier for the solids. Such a flush liquid may, for example, be a high boiling range vacuum gas oil having a boiling range from about 700° F. (371° C.) to about 1000° F (538° C.) or a vacuum tower bottoms stream boiling at a temperature greater than about 1000° F. (538° C.). The selection of a flush liquid depends upon the composition of the organic feed stream and the prevailing flash conditions in the flash separator, and the volume of the flush liquid is preferably limited to that required for removal of the heavy non-distillable component.

The resulting hydrogen-containing, organic vapor stream is in one embodiment removed from the flash zone and is introduced into a catalytic hydrogenation zone containing hydrogenation catalyst and maintained at hydrogenation conditions. The catalytic hydrogenation zone may contain a fixed, ebullated or fluidized catalyst bed. This reaction zone is preferably maintained under an imposed pressure from about atmospheric (0 kPa gauge) to about 2000 psig (13790 kPa gauge) and more preferably under a pressure from about 100 psig (689.5 kPa gauge) to about 1800 psig (12411 kPa gauge). Suitably, such reaction is conducted with a maximum catalyst bed temperature in the range of about 122° F. (50° C.) to about 850° F. (454° C.) selected to perform the desired hydrogenation conversion to reduce or eliminate the undesirable characteristics or components of the organic vapor stream. In accordance with the present invention, it is contemplated that the desired hydrogenation conversion includes, for example, dehalogenation, desulfurization, denitrification, olefin saturation, oxygenate conversion and hydrocracking. Further preferred operating conditions include liquid hourly space velocities in the range from about 0.05 $hr^{-1}$ to about 20 $hr^{-1}$ and hydrogen circulation rates from about 200 standard cubic feet per barrel (SCFB) (33.71 normal $m^3/m^3$) to about 50,000 SCFB (8427 normal $m^3/m^3$), preferably from about 300 SCFB (50.6 normal $m^3/m^3$) to about 20,000 SCFB (3371 normal $m^3/m^3$).

In the event that the temperature of the hydrogen-containing, organic stream which is removed from the flash zone is not deemed to be exactly the temperature selected to operate the catalytic hydrogenation zone, we contemplate that the temperature of the hydrogen-containing, organic stream may be adjusted either upward or downward in order to achieve the desired temperature in the catalytic hydrogenation zone. Such a temperature adjustment may be accomplished, for example, by the addition of either cold or hot hydrogen.

The preferred catalytic composite disposed within the hereinabove described hydrogenation zone can be characterized as containing a metallic component having hydrogenation activity, which component is combined with a suitable refractory carrier material of either synthetic or natural origin. The precise composition and method of manufacturing the carrier material is not considered essential to the present invention. Preferred carrier materials are alumina, silica, carbon and mixtures thereof. Suitable metallic components having hydrogenation activity are those selected from the group comprising having hydrogenation activity are those selected from the group comprising the metals of Groups VI-B and VIII of the Periodic Table, as set forth in the *Periodic Table of the Elements*, E. H. Sargent and Company, 1964. Thus, the catalytic composites may comprise one or more metallic components from the group of molybdenum, tungsten, chromium, iron, cobalt, nickel, platinum, palladium, iridium, osmium, rhodium, ruthenium, and mixtures thereof. The concentration of the catalytically active metallic component, or components, is primarily dependent upon a particular metal as well as the physical and/or chemical characteristics of the particular organic feedstock. For example, the metallic components of Group VI-B are generally present in an amount within the range of from about 1 to about 20 weight percent, the iron-group metals in an amount within the range of about 0.2 to about 10 weight percent, whereas the noble metals of Group VII are preferably present in an amount within the range of from about 0.1 to about 5 weight percent, all of which are calculated as if these components existed within the catalytic composite in the elemental state. It is further contemplated that hydrogenation catalytic composites may comprise one or more of the following components: cesium, francium, lithium, potassium, rubidium, sodium, copper, gold, silver, cadmium, mercury and zinc.

The hydrocarbonaceous effluent from the hydrogenation zone may be contacted with an aqueous scrubbing solution and the admixture admitted to a separation zone in order to separate a spent aqueous stream, a hydrogenated liquid phase and a hydrogen-rich gaseous phase. The contact of the hydrocarbonaceous effluent from the hydrogenation zone with the aqueous scrubbing solution may be performed in any convenient manner and is preferably conducted by co-current, in-line mixing which may be promoted by inherent turbulence, mixing orifices or any other suitable mixing means. The aqueous scrubbing solution is preferably introduced in an amount from about 1 to about 100 volume percent based on the hydrocarbonaceous effluent from the hydrogenation zone. The aqueous scrubbing solution is selected depending on the characteristics of the organic vapor stream introduced into the hydrogenation zone. For example, if the organic vapor stream to the hydrogenation zone comprises halogenated compounds, the aqueous scrubbing solution preferably contains a basic compound such as calcium hydroxide, potassium hydroxide or sodium hydroxide in order to neutralize the acid such as hydrogen chloride, hydrogen bromide and hydrogen fluoride, for example, which is formed during the hydrogenation of the halogen compounds. In the event that the organic vapor stream contains only sulfur and nitrogen compounds, water may be a suitable aqueous scrubbing solution to dissolve the resulting hydrogen sulfide and ammonia. The resulting hydrogenated hydrocarbonaceous liquid phase is recovered and the hydrogen-rich gaseous phase may be recycled to the hydrogenation zone if desired.

The resulting hydrogenated hydrocarbonaceous liquid phase is preferably recovered from the hydrogen-rich gaseous phase in a separation zone which is maintained at essentially the same pressure as the hydrogenation reaction zone and as a consequence contains dissolved hydrogen and low molecular weight normally gaseous hydrocarbons if present. In accordance with the present invention, it is preferred that the hydrogenated hydrocarbonaceous liquid phase comprising the hereinabove mentioned gases be stabilized in a convenient manner, such as, for example, by stripping or flashing to remove the normally gaseous components to provide a stable hydrogenated distillable hydrocarbonaceous product.

In accordance with the present invention, the heavy stream comprising a non-distillable component recovered from the hot hydrogen flash separator is reacted in a pyrolysis zone in the presence of hydrogen to provide a pyrolysis zone effluent. The pyrolysis zone serves to convert the heavy stream comprising a non-distillable component and to provide a solid and a gaseous pyrolysis zone effluent which comprises distillable hydrocarbonaceous compounds. In the event that the feed to the pyrolysis zone contains particulate matter or particulate matter is formed in the pyrolysis zone, the particulate matter becomes associated with the solid that is formed in the pyrolysis zone. The resulting segregation, encapsulation and stabilization of particulate matter in the solid which is significantly less voluminous than the original organic feedstock is considered to be advantageous. The resulting gaseous pyrolysis zone effluent which may contain distillable hydrocarbonaceous compounds, organic compounds, and hydrogen halide compounds is in one embodiment preferable cooled, washed with an aqueous scrubbing solution and separated to yield a fuel gas product stream which may contain normally gaseous hydrocarbons such as methane, ethane, propane, butane and their olefinic homologs, for example, and a normally liquid distillable organic stream. In a preferred embodiment of the present invention, at least a portion of the normally liquid distillable organic stream recovered from the gaseous effluent of the pyrolysis zone is introduced into a hydrogenation zone and subsequently recovered as a portion of the hydrogenated distillable hydrocarbonaceous product. The solid may be recovered from the pyrolysis zone in any convenient manner.

In accordance with one embodiment of the present invention, the gaseous effluent from the pyrolysis zone is contacted with an aqueous scrubbing solution in an absorption zone. This contacting in the absorption zone may be performed in any convenient manner and in one embodiment is preferably conducted by a countercurrent contacting of the pyrolysis zone effluent with water or a lean aqueous scrubbing solution in an absorber or an absorption zone. In the event that the pyrolysis zone effluent contains a hydrogen halide acid gas such as hydrogen chloride, for example, an absorber solution rich in water-soluble hydrogen halide is then recovered from the absorber and may be used as recovered or may be regenerated to provide a lean absorber solution which may be recycled to the absorber to accept additional water-soluble hydrogen halide. In the event that the pyrolysis zone effluent contains only relatively small quantities of hydrogen halide, an aqueous alkaline solution may suitably be used in order to neutralize the pyrolysis zone effluent.

The aqueous scrubbing solution is preferably introduced into the absorber in an amount from about 0.1 to about 20 times the mass flow rate of the pyrolysis zone effluent. The absorber is preferably operated at conditions which include a temperature from about 32° F. (0° C.) to about 300° F. (149° C.) and a pressure from about atmospheric (0 kPa gauge) to about 2000 psig (13790 kPa gauge). The absorber is preferably operated at essentially the same pressure as the pyrolysis zone subject to fluid flow pressure drop. The aqueous scrubbing solution is selected depending on the characteristics of the organic feed stream introduced into the process. In accordance with one embodiment of the present invention at least some halogenated organic compounds are introduced as feedstock and therefore the aqueous scrubbing solution preferably contains water or a lean aqueous solution of the hydrogen halide compound. This permits the subsequent recovery and use of a desirable and valuable hydrogen halide compound. The final selection of the absorber solution is dependent upon the particular hydrogen halide compounds which are present and the desired end product.

The resulting scrubbed effluent from the absorber is preferably separated to provide a stream containing normally gaseous hydrocarbons and another stream containing normally liquid organic compounds. The stream containing normally gaseous hydrocarbons may be used for any convenient purpose including fuel gas, for example. The stream containing normally liquid organic compounds is, in one embodiment, preferably introduced into the catalytic hydrogenation zone which is described hereinabove.

The pyrolysis zone utilized in the present invention is preferably operated at pyrolysis conditions which include an elevated temperature in the range of about 400° F. (204° C.) to about (510° C.), a pressure from about 1 psig (6.9 kPa gauge) to about 1000 psig (6895 kPa gauge).

In the drawing, the process of the present invention is illustrated by means of a simplified flow diagram in which such details as pumps, instrumentation, heat-exchange and heat-recovery circuits, compressors and similar hardware have been deleted as being non-essential to an understanding of the techniques involved. The use of such miscellaneous appurtenances are well within the purview of one skilled in the art.

With reference now to the drawing, a liquid organic feed stream having a non-distillable component is introduced into the process via conduit 1 and is contacted with a hot gaseous hydrogen-rich recycle stream which is provided via conduit 6 and hereinafter described. The liquid organic feed stream and the hydrogen-rich recycle stream are intimately contacted in hot hydrogen flash separator 2. An organic vapor stream comprising hydrogen is removed from hot hydrogen flash separator 2 via conduit 3, partially condensed in heat exchanger 4 and introduced via conduit 3 into vapor-liquid separator 5. A hydrogen-rich gaseous stream is removed from vapor-liquid separator 5 via conduit 6, heated to a suitable temperature in heat-exchanger 7 and utilized to contact the organic feed stream as hereinabove described. Since hydrogen is lost in the process by means of a portion of the hydrogen being dissolved in the exiting liquid organic stream and hydrogen being consumed during the hydrogenation reaction, it is necessary to supplement the hydrogen-rich gaseous stream with make-up hydrogen from some suitable external source, for example, a catalytic reforming unit or a hydrogen plant. Make-up hydrogen may be introduced into the system at any convenient and suitable point, and is introduced in the drawing via conduit 21. A liquid organic stream comprising hydrogen in solution and having a reduced level of non-distillable components is removed from vapor-liquid separator 5 via conduit 8 and introduced into hydrogenation reaction zone 9.

A heavy non-distillable stream is recovered from the bottom of hot hydrogen flash separator 2 via conduit 12, is contacted with a hydrogen-rich gaseous stream provided via conduit 11 and the resulting admixture is introduced via conduit 12 into pyrolysis zone 13 which is operated at conditions to produce a solid which is recovered via conduit 14 and to provide a gaseous pyrolysis zone effluent comprising distillable organic compounds. The resulting organic pyrolysis zone effluent is introduced into caustic wash zone 16 via conduit 15 in order to neutralize any acid gases which may be present. The organic effluent from caustic wash zone 16 is transported via conduit 17 and introduced into vapor-liquid separator 18. A gaseous stream comprising normally gaseous hydrocarbons is removed from vapor-liquid separator 18 via conduit 19 and recovered. A liquid distillable organic stream is removed from vapor-liquid separator 18 via conduit 20 and introduced into the above-mentioned hydrogenation zone 9 via conduit 8. A stream containing hydrogenated hydrocarbonaceous compound is removed from hydrogenation zone 9 via conduit 10 and recovered.

The following example is presented for the purpose of further illustrating the process of the present invention and to indicate the benefits afforded by the utilization thereof in producing a distillable hydrogenated hydrocarbonaceous product and a solid having a minimum of organic compounds while minimizing thermal degradation of the organic feed stream containing a non-distillable component.

EXAMPLE

A distillation residue from vinyl chloride monomer production having the characteristics presented in Table 1 was charged at a rate of 100 mass units per hour to a hot hydrogen flash separation zone. Hot hydrogen was introduced into the hot hydrogen flash separation zone at a rate of ~50 mass units per hour.

TABLE 1

| DISTILLATION RESIDUE FEEDSTOCK PROPERTIES | | |
|---|---|---|
| Specific Gravity @ 60° F.(15° C.) | 1.32 | |
| Distillation Boiling Range, | °F. | (°C.) |
| IBP | 199 | (93) |
| 10% | 223 | (106) |
| 50% | 319 | (159) |
| 90% | — | — |
| EP | — | — |
| % Over | 86 | 86 |
| % Bottoms | 14 | 14 |
| Carbon, weight percent | 32.2 | |
| Hydrogen, weight percent | 3.7 | |
| Chlorine, weight percent | 62.5 | |
| Heptane Insolubles, weight percent | 2.57 | |
| Total Metals, weight ppm | 550 | |

The waste liquid feedstock was preheated to a temperature of less than 150° F. (65° C.) before introduction into the hot hydrogen flash separation zone which temperature precluded any significant detectable thermal degradation. The waste liquid feedstock was intimately contacted in the hot flash separation zone with the hot hydrogen-rich gaseous stream having a temperature upon introduction into the hot hydrogen flash separation zone of >300° F. (149° C.).

TABLE 2

| ANALYSIS OF FLASH DISTILLATE STREAM | | |
|---|---|---|
| Specific Gravity @ 60° F.(15° C.) | 1.30 | |
| Vacuum Distillation Boiling Range, | °F. | (°C.) |
| IBP | 165 | (74) |
| 10 | 172 | (78) |
| 50% | 275 | (135) |
| 90% | 419 | (215) |
| EP | 529 | (276) |
| % Over | 95 | 95 |
| % Residue | 5 | 5 |
| Carbon, weight percent | ~32 | |
| Hydrogen, weight percent | ~4 | |
| Chlorine, weight percent | 63.3 | |
| Heptane Insolubles, weight percent | <0.05 | |

TABLE 2-continued

| ANALYSIS OF FLASH DISTILLATE STREAM | | |
|---|---|---|
| Specific Gravity @ 60° F.(15° C.) | 1.30 | |
| Vacuum Distillation Boiling Range, | °F. | (°C.) |
| Total Metals, weight ppm | 22 | |

In addition, the hot hydrogen flash separation zone was operated at conditions which included a temperature of 248° F. (120° C.), a pressure of 25 psig (172 kPa gauge) and an average residence time of the vapor stream of <10 seconds. The vapor stream was partially condensed at a temperature of about −78° F. (−61° C.) to provide a hydrogen-rich gaseous stream which was recycled back to the hot hydrogen flash separation zone and a liquid flash distillate stream in an amount of 89.3 mass units per hour and having the characteristics presented in Table 2.

A non-distillable liquid stream having the appearance of a viscous tar was recovered from the bottom of the flash separation zone in an amount of 10.7 mass units per hour. The tar was found to have a specific gravity at 60° F. (15° C.) of 1.37, contained ~52 weight percent carbon, ~5 weight percent hydrogen, 42.2 weight percent chlorine and 5000 weight ppm metals. The tar was thermally treated in the presence of hydrogen (hydrogen-pyrolysis) at conditions which included a pressure of 500 psig (3448 kPa gauge) and a temperature of 554° F. (290° C.). The thermal conversion zone produced a solid in an amount of 3.9 mass units per hour that contained 83.3 weight percent carbon, 2.4 weight percent hydrogen, 7.8 weight percent chloride and ~2.5 weight percent ash.

A vapor stream was recovered in an amount of about 6.8 mass units per hour from the thermal conversion zone and having the characteristics presented in Table 3.

TABLE 3

| | |
|---|---|
| Hydrocarbon Fuel Gas, Weight Percent | ~38 |
| Hydrogen Chloride, Weight Percent | ~62 |

A feed stream containing the flash distillate stream and a liquid organic product from the thermal conversion zone was introduced into a catalytic hydrogenation zone which was operated at conditions which included a catalyst peak temperature of 570° F. (299° C.) and a pressure of 750 psig (5171 kPa gauge). The hydrogenated effluent from the hydrogenation reaction zone including acid gas (hydrogen chloride) was scrubbed to remove the acid gas, a gaseous hydrogen-rich stream was separated from the normally liquid hydrocarbonaceous product and a hydrogenated hydrocarbonaceous stream (dehalogenated) in an amount of 38 mass units per hour was recovered.

The foregoing description, drawing and example clearly illustrate the advantages encompassed by the process of the present invention and the benefits to be afforded with the use thereof.

What is claimed:

1. A process for treating an organic stream containing a non-distillable component to produce an organic vapor stream and a solid which process comprises the steps of:

(a) contacting said organic stream containing a non-distillable component with a hydrogen-rich gaseous stream having a temperature greater than the organic stream in a flash zone at flash conditions thereby increasing the temperature of the organic stream and vaporizing at least a portion thereof to produce an organic vapor stream comprising hydrogen and a heavy stream comprising said non-distillable component; and (b) reacting at least a portion of said heavy stream comprising said non-distillable component in the presence of hydrogen in a pyrolysis zone to produce a thermally stabilized volatile organic stream comprising hydrogen and a solid.

2. The process of claim 1 wherein said organic stream comprises dielectric fluids, hydraulic fluids, heat transfer fluids, used lubricating oil, used cutting oils, used solvents, still bottoms from solvent recycle operations, coal tars, atmospheric residuum, PCB-contaminated oils, halogenated wastes, petrochemical by-products, off-specification plastic waste, used plastic waste or other organic industrial waste.

3. The process of claim 1 wherein said non-distillable component comprises organometallic compounds, inorganic metallic compounds, finely divided particulate matter, halogenated organic polymers or non-distillable organic compounds.

4. The process of claim 1 wherein said organic stream is introduced into said flash zone at a temperature less than about 482° F. (250° C.).

5. The process of claim 1 wherein the temperature of said hydrogen-rich gaseous stream is from about 200° F. (93° C.) to about 1200° F. (649° C.).

6. The process of claim 1 wherein said flash conditions include a temperature from about 150° F. (65° C.) to about 860° F. (460° C.), a pressure from about atmospheric to about 2000 psig (13788 kPa gauge), a hydrogen circulation rate of about 1000 SCFB (168 normal $m^3/m^3$) to about 100,000 SCFB (16850 normal $m^3/m^3$) based on said organic stream, and an average residence time of said organic vapor stream comprising hydrogen in said flash zone from about 0.1 seconds to about 50 seconds.

7. The process of claim 1 wherein said organic stream containing a non-distillable component comprises hazardous organic compounds.

8. The process of claim 7 wherein said hazardous organic compounds are halogenated hydrocarbons or organometallic compounds.

9. The process of claim 1 wherein said pyrolysis conditions include a temperature from about 400° F. (204° C.) to about 950° F. (510° C.), a pressure from about 1 psig (6.9 kPa gauge) to about 1000 psig (6895 kPa gauge).

10. A process for treating an organic stream containing a non-distillable component to produce a volatile organic stream and a solid which process comprises the steps of:

(a) contacting said organic stream containing a non-distillable component with a first hydrogen-rich gaseous stream having a temperature greater than the organic stream in a flash zone at flash conditions thereby increasing the temperature of the organic stream and vaporizing at least portion thereof to produce an organic vapor stream comprising hydrogen and a heavy stream comprising said non-distillable component;

(b) reacting at least a portion of said heavy stream comprising said non-distillable component in the presence of hydrogen in a pyrolysis zone at pyrolysis conditions to produce a thermally stabilized volatile organic stream comprising hydrogen and a solid;

(c) separating said organic vapor stream comprising hydrogen to produce a second hydrogen-rich gaseous stream; and (d) recycling at least a portion of said second hydrogen-rich gaseous stream recovered in step (c) to provide at least a portion of said first hydrogen-rich gaseous stream utilized in step (a).

11. The process of claim 10 wherein said organic stream comprises dielectric fluids, hydraulic fluids, heat transfer fluids, used lubricating oil, used cutting oils, used solvents, still bottoms from solvent recycle operations, coal tars, atmospheric residuum, PCB-contaminated oils, halogenated wastes, petrochemical by-products, off-specification plastic waste, used plastic waste or other organic industrial waste.

12. The process of claim 10 wherein said non-distillable component comprises organometallic compounds, inorganic metallic compounds, finely divided particulate matter, halogenated organic polymers or non-distillable organic compounds.

13. The process of claim 10 wherein said organic stream is introduced into said flash zone at a temperature less than about 482° F. (250° C.).

14. The process of claim 10 wherein the temperature of said first hydrogen-rich gaseous stream is from about 200° F. (93° C.) to about 1200° F. (649° C.).

15. The process of claim 10 wherein said flash conditions include a temperature from about 150° F. (65° C.) to about 860° F. (460° C.), a pressure from about atmospheric to about 2000 psig (13788 kPa gauge), a hydrogen circulation rate of about 1000 SCFB (168 normal $m^3/m^3$) to about 100,000 SCFB (16850 normal $m^3/m^3$) based on said organic stream, and an average residence time of said organic vapor stream comprising hydrogen in said flash zone from about 0.1 seconds to about 50 seconds.

16. The process of claim 10 wherein said organic stream containing a non-distillable component comprises hazardous organic compounds.

17. The process of claim 10 wherein said hazardous organic compounds are halogenated hydrocarbons or organometallic compounds.

18. The process of claim 10 wherein said pyrolysis conditions include a temperature from about 400° F. (204° C.) to about 950° F. (510° C.), a pressure from about 1 psig (6.9 kPa gauge) to about 1000 psig (6895 kPa gauge).

19. A process for treating an organic stream containing a non-distillable component to produce distillable organic compounds and a solid which process comprises the steps of:

(a) contacting said organic stream containing a non-distillable component with a first hydrogen-rich gaseous stream having a temperature greater than the organic stream in a flash zone at flash conditions thereby increasing the temperature of the organic stream and vaporizing at least a portion thereof to produce an organic vapor stream comprising hydrogen and a heavy stream comprising said non-distillable component;

(b) reacting at least a portion of said heavy stream comprising said non-distillable component in the presence of hydrogen in a pyrolysis zone at pyrolysis conditions to produce a thermally stabilized volatile organic stream comprising hydrogen and a solid;

(c) contacting at least a portion of said organic vapor stream comprising hydrogen produced in step (a) and at least a portion of said thermally stabilized volatile organic stream comprising hydrogen produced in step (b) with a hydrogenation catalyst in a hydrogenation reaction zone at hydrogenation conditions;

(d) separating at least a portion of said organic vapor stream comprising hydrogen produced in step (a) to produce a second hydrogen-rich gaseous stream;

(e) recycling at least a portion of said second hydrogen-rich gaseous stream recovered in step (d) to provide at least a portion of said first hydrogen-rich gaseous stream utilized in step (a); and (f) recovering distillable hydrocarbonaceous compounds from the effluent of said hydrogenation reaction zone.

20. The process of claim 19 wherein said hydrogenation reaction zone is operated at conditions which include a pressure from about atmospheric (0 kPa gauge) to about 2000 psig (13790 kPa gauge), a maximum catalyst temperature from 122° F. (50° C.) to about 850° F. (454° C.) and a hydrogen circulation rate from 200 SCFB (33.7 normal $m^3/m^3$) to about 50,000 SCFB (8427 normal std $m^3/m^3$).

21. The process of claim 19 wherein said hydrogenation catalyst comprises a refractory inorganic oxide and at least one metallic compound having hydrogenation activity.

22. The process of claim 21 wherein said metallic compound is selected from the metals of Group VIB and VIII of the Periodic Table.

* * * * *